US011572715B2

(12) United States Patent
Schiffer et al.

(10) Patent No.: US 11,572,715 B2
(45) Date of Patent: Feb. 7, 2023

(54) MOTOR VEHICLE LOCK

(71) Applicant: Kiekert AG, Heiligenhaus (DE)

(72) Inventors: Holger Schiffer, Meerbusch (DE); Michael Scholz, Essen (DE); Cyrille Roussel, Mettmann (DE)

(73) Assignee: Kiekert AG, Heiligenhaus (DE)

( * ) Notice: Subject to any disclaimer, the term of this patent is extended or adjusted under 35 U.S.C. 154(b) by 64 days.

(21) Appl. No.: 17/043,363

(22) PCT Filed: Apr. 15, 2019

(86) PCT No.: PCT/DE2019/100344

§ 371 (c)(1),
(2) Date: Sep. 29, 2020

(87) PCT Pub. No.: WO2019/206370

PCT Pub. Date: Oct. 31, 2019

(65) Prior Publication Data

US 2021/0040781 A1 Feb. 11, 2021

(30) Foreign Application Priority Data

Apr. 25, 2018 (DE) ..... DE10 2018 109 898.7

(51) Int. Cl.
*E05B 81/06* (2014.01)
*E05B 81/16* (2014.01)
(Continued)

(52) U.S. Cl.
CPC ..... *E05B 81/06* (2013.01); *E05B 81/16* (2013.01); *E05B 15/0053* (2013.01);
(Continued)

(58) Field of Classification Search
CPC ..... E05B 81/06; E05B 81/16; E05B 15/0053; E05B 15/006; E05B 77/26; E05B 77/28; E05B 2015/0496
See application file for complete search history.

(56) References Cited

U.S. PATENT DOCUMENTS

2008/0060396 A1 3/2008 Harvey
2014/0091580 A1* 4/2014 Schoenenbergo ..... E05B 83/36 292/200

(Continued)

FOREIGN PATENT DOCUMENTS

CN 107339030 A 11/2017
DE 19713864 A1 * 10/1998 ..... E05B 81/06

(Continued)

OTHER PUBLICATIONS

Translation of International Search Report dated Jul. 10, 2019, for PCT/DE2019/100344.

(Continued)

*Primary Examiner* — Kristina R Fulton
*Assistant Examiner* — James E Ignaczewski
(74) *Attorney, Agent, or Firm* — Renner, Otto, Boisselle & Sklar, LLP

(57) ABSTRACT

A motor vehicle lock, in particular for a vehicle rear door, having a lock cover and a locking mechanism consisting essentially of a rotary latch and at least one pawl, also comprising at least one coupling element, and at least one electric drive, wherein the coupling element can assume different positions, and the coupling element interacts with a drive element of the drive and a central locking mechanism, wherein the coupling element is connected to the drive element in order to take up its positions.

16 Claims, 4 Drawing Sheets

(51) Int. Cl.

| | |
|---|---|
| *E05B 15/00* | (2006.01) |
| *E05B 77/26* | (2014.01) |
| *E05B 77/28* | (2014.01) |
| *E05B 15/04* | (2006.01) |

(52) U.S. Cl.
CPC ..... *E05B 77/26* (2013.01); *E05B 77/28* (2013.01); *E05B 2015/0496* (2013.01)

(56) References Cited

U.S. PATENT DOCUMENTS

| | | | | |
|---|---|---|---|---|
| 2017/0328086 | A1* | 11/2017 | Takada | E05B 47/0001 |
| 2020/0340277 | A1* | 10/2020 | Robert | E05B 81/14 |

FOREIGN PATENT DOCUMENTS

| | | | | | |
|---|---|---|---|---|---|
| DE | 19739340 | A1 | | 3/1999 | |
| DE | 19943483 | B4 | | 3/2008 | |
| DE | 102007055413 | A1 | * | 5/2009 | E05B 77/24 |
| DE | 102008011545 | A1 | | 9/2009 | |
| DE | 202012002853 | U1 | | 6/2013 | |
| DE | 102013215766 | A1 | * | 2/2015 | E05C 1/06 |
| DE | 102014000680 | A1 | | 7/2015 | |
| DE | 202014103113 | U1 | | 10/2015 | |
| DE | 202014103113 | U1 | * | 11/2015 | E05B 15/0073 |
| DE | 102015113122 | A1 | | 2/2017 | |
| DE | 102017111704 | A1 | * | 12/2018 | E05B 15/0053 |
| WO | 2012139544 | A1 | | 10/2012 | |

OTHER PUBLICATIONS

Third Office Action dated Oct. 9, 2022, for corresponding Chinese Patent Application No. 201980027548.7.

* cited by examiner

MOTOR VEHICLE LOCK

FIELD OF DISCLOSURE

The present invention relates to the field of motor vehicle locking systems and relates to a motor vehicle latch according to the disclosure. A motor vehicle latch includes a latch cover and a locking mechanism substantially consisting of a catch and at least one pawl and also at least one coupling element and at least one electric drive, it being possible for the coupling element to assume different positions and the coupling element interacting with a drive element of the drive and a central locking mechanism, the coupling element being connected to the drive element in order to assume its positions.

BACKGROUND OF DISCLOSURE

A motor vehicle latch of the type described at the outset is usually attached to a motor vehicle door on one side and interacts with a vehicle body-side locking bolt. Furthermore, the arrangement may, however, also be the other way around so that the closure bolt is arranged on the motor vehicle door and the latch is arranged on the motor vehicle.

Such motor vehicle latches are equipped with a central locking mechanism and usually comprise different positions and functions associated with those positions. In this case, it is conceivable for the positions of the coupling element to be adjusted by means of the drive. Such motor vehicle latches are known from DE 199 43483B4, for example. Here, an anti-theft module is formed on the one hand and a locking module is formed on the other hand. In addition, it is possible to lift the pawl by means of the anti-theft module either directly or, where applicable, by interposing a release lever.

However, the motor vehicle latches known in the art are disadvantageous in that the coupling element may not be reliably positioned by means of the drive element.

There is therefore the need to develop motor vehicle latches so as to develop a position of the coupling element and a functional position of the central locking mechanism such that the above problems are solved constructively and cost-effectively.

SUMMARY OF DISCLOSURE

The technical problem addressed by the present invention is therefore to overcome at least some of the disadvantages known in the art. In particular, the object of the present invention is to provide a motor vehicle latch in a cost-effective manner that has an advantageous design and can ensure the position of the coupling element.

The above problem is solved by a motor vehicle latch having the features of the disclosure and by a method having the features of the disclosure.

Additional features, details, advantageous developments and improvements to the invention may be found in the description and the drawings. In this case, the features described in the description and the drawings may be combined or modified in any technologically reasonable manner and may demonstrate additional configurations of the invention. It is pointed out that the exemplary embodiments described in the following to explain the invention are not restrictive. In this case, features and details that are described in connection with the motor vehicle door latch according to the invention are of course also applicable in connection with the method according to the invention, and vice versa, and therefore reference may always be reciprocally made to the disclosure of the individual aspects of the invention.

According to the invention, the motor vehicle latch, in particular a motor vehicle latch for a vehicle rear door, comprises a latch cover and a locking mechanism, the locking mechanism substantially comprising a catch and at least one pawl. Furthermore, the motor vehicle latch comprises at least one coupling element and at least one electric drive, it being possible for the coupling element to assume different positions and the coupling element interacting with a drive element of the drive and a central locking mechanism, the coupling element being connected to the drive element in order to assume the positions. According to the invention, the drive element and/or the latch cover comprise(s) a ratchet contour having at least two positioning notches, a spring mechanism being provided and the spring mechanism interacting with the positioning notches of the ratchet contour such that the coupling element may be positioned in the different positions.

Henceforth, one advantage of the invention is that the drive element and/or the latch cover comprise(s) a ratchet contour and interact(s) with the spring mechanism such that the coupling element may be reliably positioned or fixed in the different positions. The spring mechanism accordingly acts on the ratchet contour, in particular in the positioning notches of the ratchet contour, by means of a spring force such that the drive element is held in the different positions by the spring force of the spring mechanism. Accordingly, a position determination or positioning may be established there.

Within the context of the invention, the positions may also refer to functional positions. In this case, it is conceivable for a first position to be defined by the functional position "child lock engaged/releasable." In this functional position, the child lock is engaged, but may be released/disengaged by repeatedly operating an internal door operating element. A second position may be defined by the functional position "child lock disengaged." A possible third position may be defined by the functional position "child lock disengaged." Alternatively or in addition, the functional positions "central locking engaged," "central locking disengaged" and/or "theft-protection engaged" and "theft-protection disengaged" may also be provided. If "child lock" is referred to in the following, this may alternatively or additionally also be used for an anti-theft security system and/or central locking such that "child lock" is used as a synonym for the functions child lock, theft-protection, and central latching.

Within the context of the invention, in addition to a latch housing, a motor vehicle latch may also comprise a latch case and a latch cover, by means of which the latch case may be closed. The locking mechanism is mounted in the latch case, which is composed of a catch and at least one pawl that interacts therewith. The catch and consequently the motor vehicle door latch defined in this manner interact with the closure bolt in a known manner.

As is customary, the latch housing may be arranged on the vehicle body or on the hood or door. In the first case, the latch housing is mounted on a vehicle body by means of screws, for example. The variant mentioned second corresponds to the latch housing, and, together therewith, the door latch, being attached inside or on a door, a hood, a flap or the like.

If the invention refers to a motor vehicle latch, this therefore includes such motor vehicle latches that are used in side doors, sliding doors, flaps, hoods and/or cover panels, for example, where components are arranged on the motor vehicle so as to be pivotally or displaceably mounted. It is also conceivable for the motor vehicle latch to be arranged in a backrest of a seat.

The coupling element according to the invention is preferably rotatably arranged on the drive element of the drive. According to the invention, the drive element may now be rotatable about an axis, whereby the drive element may be rotated about the axis of rotation into the different positions by means of the drive. Accordingly, the coupling element connected to the drive element is moved into the different positions. In this case, the drive element may be mechanically and/or electrically driven into the different positions, wherein the particular position is changed either purely mechanically or purely electrically.

Motor vehicle side doors and consequently the associated motor vehicle door locks may be transferred into different positions or functional positions, as already mentioned. Within the context of the invention, a locked state, for example, may be referred to in that said motor vehicle side door may not be opened from the outside or the action upon a corresponding external door handle or external operating element constantly does not function. In this functional state, the motor vehicle side door may still be opened from the inside by means of an internal door operating element or internal door handle and therefore the internal operating lever acted upon thereby.

In contrast, the unlocked position of the motor vehicle latch and consequently also the functional position of the associated motor vehicle door corresponds to the motor vehicle door being openable by both an external door operating element and the internal door operating element being acted upon independently of one another.

In addition, the position or functional position "child-locked" may also be achieved on the rear motor vehicle side doors. In the child-locked position, an associated internal door operating element is inoperative, such that the relevant motor vehicle side door may not be opened when a passenger operates the internal operating element. In contrast, the external door handle is in engagement with the locking mechanism as before, such that the relevant motor vehicle side door may be opened from the outside.

Another functional position may be referred to as anti-theft, whereby, in the anti-theft position, both the external door handle and the internal door handle remain non-functional in the position. This ensures that a motor vehicle door does not provide access to the inside of the motor vehicle even if the motor vehicle window is smashed.

In order for the motor vehicle latch and therefore the drive element comprising the coupling element and the central locking mechanism may be transferred to the different positions or functional positions, according to the invention a spring mechanism is provided, which interacts with the positioning notches of the ratchet contour of the drive element or the latch cover. In this case, one or more spring elements may be provided.

The embodiment according to the invention is also advantageous in that less installation space is required and the spring may have a simpler design. This is a result of the spring mechanism directly interacting with the positioning notches of the ratchet contour and the spring force acting on the positioning notches of the ratchet contour by means of clear and definable or calculable force vectors. Since the spring mechanism interacts with the positioning notches, installation space may be saved and the spring may be designed more effectively, since there is no angular clearance. The angular clearance is substantially saved or prevented by the design of the spring mechanism and the positioning notches.

The first coupling element according to the invention may be formed as a coupling lever, for example. A second coupling element may, in contrast, be formed as an external locking lever.

The spring mechanism according to the invention may predominantly be formed as a leg spring, in particular as a double leg spring. A leg spring allows for a cost-effective design of a motor vehicle latch in this case, whereby a sufficient amount of spring force may be provided at the same time in order to position the drive element and therefore the coupling element. The leg spring, in particular the double leg spring, makes it possible to exert a direct transmission of force on the positioning notches of the ratchet contour in this case. The spring mechanism is therefore preferably arranged on the latch housing or the latch case or the latch cover and interacts with the positioning notches of the ratchet contour of the drive element or the latch cover. In a double leg spring, the ends of the limbs may preferably be mounted in the latch housing, the latch cover or the latch case. Accordingly, the spring may be supported on the bearing points on the one hand and may act on the ratchet contour of the drive element or the latch cover by means of a spring force on the other hand.

Within the context of the invention, the spring mechanism, in particular the double leg spring, may be arranged on the latch cover, on the coupling element or on the drive element, it being possible for a turn portion of the spring mechanism to be brought into contact at least with the positioning notches of the ratchet contour in order to fix it in position. Accordingly, the turn portion of the spring mechanism comprises at least one point of contact with the positioning notches of the ratchet contour. By means of the torsion spring force of the spring, the turn portion is always pressed on the ratchet contour or the positioning notches of the ratchet contour on the drive element. In this case, the spring is preferably always pretensioned by its bearing points such that there is no angular clearance between the drive element and the spring mechanism. The leg spring preferably comprises approximately one to approximately 15 turns, preferably between approximately 5 turns and approximately 10 turns. Furthermore, it may be advantageous for the spring mechanism to be a steel spring or a plastics spring.

Furthermore, it is conceivable for the spring mechanism to comprise a pressure spring or to be formed as a pressure spring and to be arranged on the drive element, it being possible for at least portions of the pressure spring to be brought into contact with the positioning notches on the latch cover, as a result of which the different positions are maintained. In this embodiment, too, it is advantageous when the spring mechanism is made of steel and/or plastics material. The pressure spring therefore makes it possible to directly transfer the force to the positioning notches of the ratchet contour of the drive element or of the latch cover.

The pressure spring is particularly preferably arranged in a spring receptacle on the drive element, in particular a positioning element being provided that is operatively connected to the pressure spring, as a result of which the positioning element is pressed against the ratchet contour, in particular the positioning notches. In this case, the spring receptacle may be formed as a hole in the drive element or in the latch cover, for example. The pressure spring is therefore always pretensioned such that there is no angular clearance between the drive element and the latch cover. The pressure spring is fixed and/or guided in this spring receptacle such that the force of the spring may be transferred to the positioning notches on the ratchet contour. The positioning element may preferably be in the shape of a pin and/or sphere. At least portions of the positioning element are advantageously arranged and guided in the spring receptacle. Accordingly, the positioning element is arranged at one end of the pressure spring. The other end of the pressure spring is supported against the spring receptacle such that the positioning element comes into contact with the ratchet contour.

The drive element may advantageously be formed as a worm wheel and comprise an external teeth portion, which may be brought into engagement with the electric drive. In particular, the external teeth portion may be brought into engagement with a screw conveyor of the electric drive. Accordingly, the drive element is formed having external teeth and is rotatably arranged on the latch cover or latch housing by means of a bearing. The drive element formed as a worm wheel preferably comprises a plastics material. The external teeth portion and the ratchet contour, in particular the positioning notches, are preferably arranged on the drive element so as to be diametrically opposite the external teeth portion. As a result of being formed as a worm wheel having an external teeth portion, additional installation space may be saved and a cost-effective motor vehicle latch may be provided. In particular, when the external teeth portion and the ratchet contour are diametrically opposite one another, a compact construction may be achieved.

Furthermore, it is conceivable for the external teeth portion to be formed on a first plane on the circumference of the drive element and for the ratchet contour to be formed on an at least second plane. This is advantageous in that the angle of rotation is increased and more positions may be achieved. In this case, "on different planes" means that several planes or steps may be formed along the rotary shaft of the drive element.

The ratchet contour may advantageously be substantially wave-shaped or substantially V-shaped and each positioning notch may comprise at least one, preferably two, abutment surfaces with which the turn portion of the spring mechanism, in particular of the double leg spring, may be brought into contact, the abutment surface in particular being substantially straight. In particular, the ratchet contour and therefore the positioning notch on the drive element or the latch cover is concave. The concave rounded portions in the form of positioning notches of the ratchet contour are semicircular in this case such that a wave geometry is substantially formed. The positioning notches and the turn portion of the spring mechanism therefore have at least two points of contact with one another, in which force is transmitted from the spring mechanism to the ratchet contour.

This is advantageous in that the spring may be designed, calculated and therefore disengaged more simply; the lever arm between the spring mechanism and the drive element may therefore be defined by means of the definable abutment surfaces and therefore points of contact between the spring mechanism and the positioning notches. For this, each positioning notch comprises at least one, preferably two, straight abutment surfaces against which the turn portion of the spring mechanism rests. The outer portions of the substantially semicircular positioning notches are therefore straight and without no longer curved. Accordingly, a combination of wave-shaped and V-shaped positioning notches is provided. If the positioning notches are considered to be substantially U-shaped, the limbs comprise no more outwardly rounded portions. Instead, the limbs are formed as straight lines toward the end.

Furthermore, it is conceivable for the spring mechanism, in particular the double leg spring, to comprise at least two fastening ends, each fastening end being arranged in a fastening receptacle, in particular in a slot, in each case. In this case, the fastening receptacle is preferably formed in the latch cover or the drive element. When a double leg spring is deformed, the slot therefore makes it possible for the fastening ends of the double leg spring to be able to move in the slot. Furthermore, fastening the fastening ends in the fastening receptacles, in particular in the slot, allows for a defined force transmission from the spring mechanism to the ratchet contour and therefore the positioning notches to be possible. Clearance may also be compensated for by fastening a fastening end of the spring mechanism, in particular in at least one slot.

Within the context of the finding, the coupling element may be rotatably mounted on a bearing receptacle on the drive element. In particular, it is conceivable for the bearing receptacle to be arranged on the back of the ratchet contour. For example, the bearing receptacle may be formed as a hole in the drive element or in the coupling element, whereby the drive element and the coupling element are interconnected by means of a bearing pin or bolt.

According to the invention, it may be advantageous for two coupling elements to be provided, whereby the first coupling element is connected to the second coupling element by means of a transmission lever. In this case, the first or the second coupling element is operatively connected to the central locking mechanism. Accordingly, by means of a lever mechanism, the central locking mechanism may be moved into the different functional positions. This may make it possible to move the first coupling element on the second coupling element. The transmission lever is preferably movably mounted on the first coupling element and/or the second coupling element by means of a ball head. By means of a driving arm, the transmission lever may transfer a movement of the first or second coupling element to the other coupling element in each case. The first coupling element according to the invention may be formed as a coupling lever, for example. In contrast, a second coupling element may be formed as an external locking lever.

According to another aspect of the invention, a method is claimed for operating a child lock of a motor vehicle latch, in particular of the motor vehicle latch according to the invention. The motor vehicle latch comprises a latch cover and a locking mechanism substantially consisting of a catch and at least one pawl, and further comprises at least one coupling element and at least one electric drive, it being possible for the coupling element to assume different positions and the coupling element interacting with a drive element of the drive and a central locking mechanism, the coupling element being connected to the drive element in order to assume its positions. The drive element and/or the latch cover comprise(s) a ratchet contour having at least two positioning notches, a spring mechanism being provided, the spring mechanism interacting with the positioning notches of the ratchet contour such that the coupling element may be positioned in the positions and the child lock may be engaged, disengaged and/or released.

BRIEF DESCRIPTION OF DRAWINGS

Additional measures that improve the invention may be found in the following description of a few exemplary embodiments of the invention, which are shown schematically in the drawings. It should be noted here that the drawings are only descriptive in nature and are not intended to limit the invention in any way. Other embodiments to those included in and disclosed by the invention may therefore also be taken into consideration, which are not explicitly shown or explained in the drawings, but are clear from and may be produced by the embodiments mentioned as a result of separate combinations of features. In the figures, the same reference signs denote components that are the same or have the same function, unless stated otherwise.

In the figures.

DETAILED DESCRIPTION

Figure 1A:
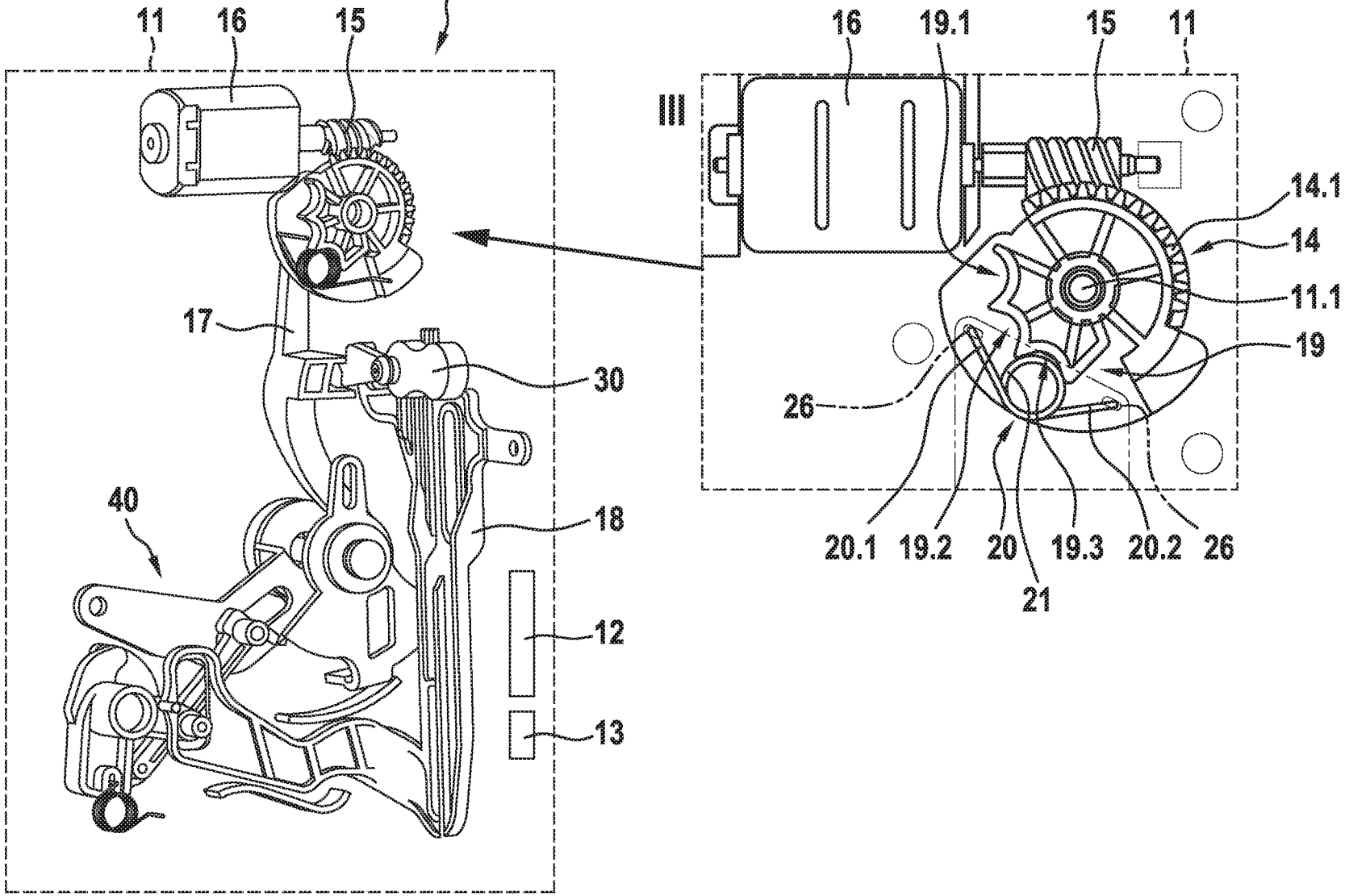
FIG. 1A shows a first possible embodiment of a motor vehicle latch according to the invention in position III.

FIG. 1A shows a first possible embodiment of a motor vehicle latch 10 according to the invention, comprising a latch cover 11 and a locking mechanism having a catch 12 and a pawl 13. Furthermore, the motor vehicle latch comprises a coupling element 17 and an additional coupling element 18, the coupling element 17 being mounted on a drive element 14. The second coupling element 18 is connected to a central locking mechanism 40. The first coupling element 17 and the second coupling element 18 are operatively connected to one another by means of a transmission lever 30. The drive element 14 may be transferred to the different positions/functional positions by means of the electric drive 15, 16. The first coupling element 17 according to the invention is formed as a coupling lever. In contrast, the second coupling element 18 is formed as an external locking lever.

FIG. 1A shows the motor vehicle latch in position III and therefore the functional position "child lock engaged/releasable."

In this case, the drive element 14 comprises a ratchet contour 19 having a total of three positioning notches 19.1, 19.2 and 19.3. The ratchet contour 19 comprising the positioning notches 19.1, 19.2 and 19.3 interact with the spring mechanism 20 such that the drive element 14 and therefore the coupling elements 17, 18 connected thereto may be fixed in position 3. The spring mechanism 20 is formed as a double leg spring in FIG. 1A, the double leg spring 20 comprising a turn portion 21 and the turn portion 21 interacting with the positioning notches 19.3. For this, the turn portion 21 of the spring mechanism 20 contacts the positioning notch 19.3 at two contact points. The drive element 14 is formed as a worm wheel in this case and comprises an external teeth portion 14.1.

The spring mechanism 20 in the form of the double leg spring 20 comprises two fastening ends 20.1 and 20.2 in this case, the fastening ends 20.1 and 20.2 of the double leg spring 20 being fastened in a slot 26 in the latch cover of the motor vehicle latch 10 in each case.

The electric drive 15, 16 consists of a motor 16 and a screw conveyor 15, the screw conveyor 15 engaging with the external teeth portion 14.1 of the drive element 14 so that a force may be transferred by means of the motor 16 from the screw conveyor 15 to the drive element 14 such that the drive element 14 may rotate about an axis. Accordingly, the drive element 14 may be moved into the different positions and therefore functional positions. On the whole, in FIG. 1A the drive element 14 comprises three positioning notches 19.1, 19.2 and 19.3. In this case, these positioning notches may, according to the invention, assume the positions "child lock engaged," "child lock disengaged" and/or "child lock engaged/releasable."

In FIG. 1A, the drive element 14 is shown in position III, position III corresponding to the functional position "child lock engaged/releasable." In this position, it is possible to disengage the child lock by means of repeatedly operating the internal operating element from inside the motor vehicle. If the drive element 14 is then moved into the different positions by means of the drive 15, 16, the coupling element 17 and the coupling element 18 move according to the change of position. Therefore, the motor vehicle latch may be transferred into the 3 functional positions, preferably electrically, by means of the drive 14, 15, 16.

Figure 1B:
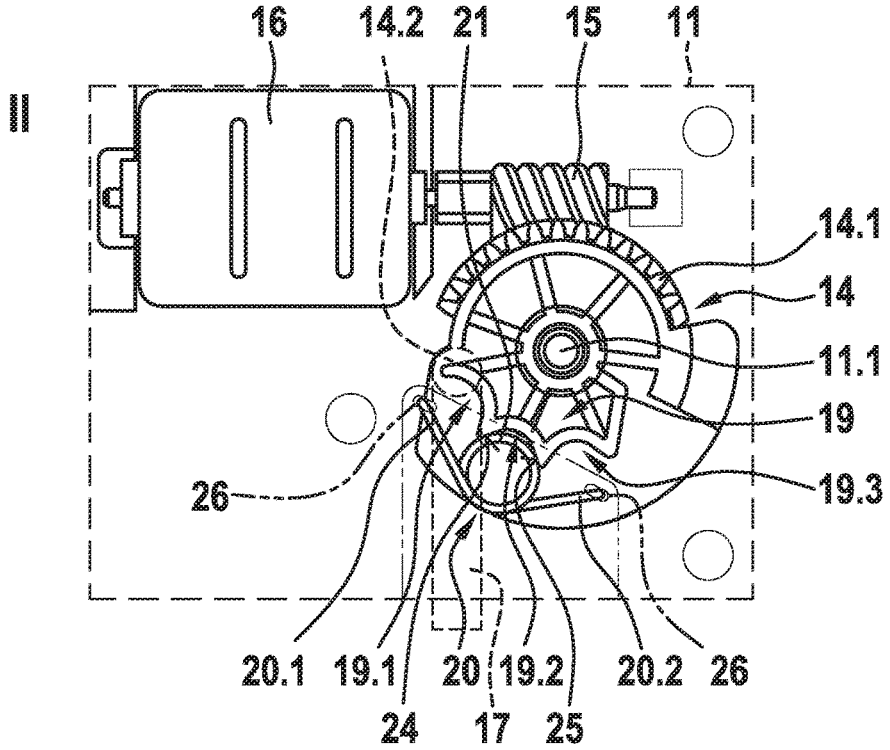
FIG. 1B is a cut-out of the motor vehicle latch in the first embodiment in position II.

FIG. 1B shows a cut-out of the motor vehicle latch 10, the cut-out in particular showing the drive 14, 15, 16. In this case, this drive 14, 15, 16 comprises the motor 16, the screw conveyor 15 and the drive element 14. In position II, which is shown in FIG. 1B, the functional position "child lock disengaged" is reached. Here, the turn portion 21 of the double leg spring 20 is arranged in the positioning notch 19.2. In this case, the turn portion 21 of the spring mechanism 20 comprises two points of contact with the positioning notch 19.2. The contact points are each arranged on the abutment surfaces 24 and 25. The abutment surfaces are straight in this case. If the positioning notch 19.1, 19.2 or 19.3 is considered to be substantially U-shaped, the limbs comprise no more outwardly rounded portions. Rather, the limbs are formed as straight lines toward the end and therefore in the region of the abutment surfaces 24, 25.

The design of the drive element 14, the screw conveyor 15 and of the motor 16 corresponds to that in FIG. 1A.

In FIG. 1B, the double leg spring 20 is likewise mounted in a slot 26 by a fastening end 20.1, 20.2 of the double leg spring 20 in each case. In FIG. 1B, only the coupling element 17 is shown and is arranged on the side opposite/facing away from the ratchet contour, as shown in FIG. 1A. In this case, the coupling lever 17 is rotatably mounted on the bearing receptacle 14.2.

The position shown, position II, and therefore the functional position "child lock disengaged" is achieved by the motor 16 driving the screw conveyor 15 and the screw conveyor 15 transferring the force to the external teeth portion 14.1 of the drive element 14 such that the drive element 14 is rotated anti-clockwise around the shaft 11.1. In this case, the turn portion 21 of the spring mechanism 20 contacts the ratchet contour and snaps into the positioning notches 19.1, 19.2 or 19.3. In the positioning notch 19.2 shown in FIG. 1B, the spring mechanism 20 in the form of a double leg spring once again comprises two points of contact with the abutment surfaces 24, 25 of the ratchet contour 19 or with the positioning notches in the region of the turn portion 21. In this case, at least portions of the ratchet contour 19 are straight in the region of the positioning notches 19.1, 19.2, 19.3 on the abutment surfaces 24, 25.

Figure 1C:
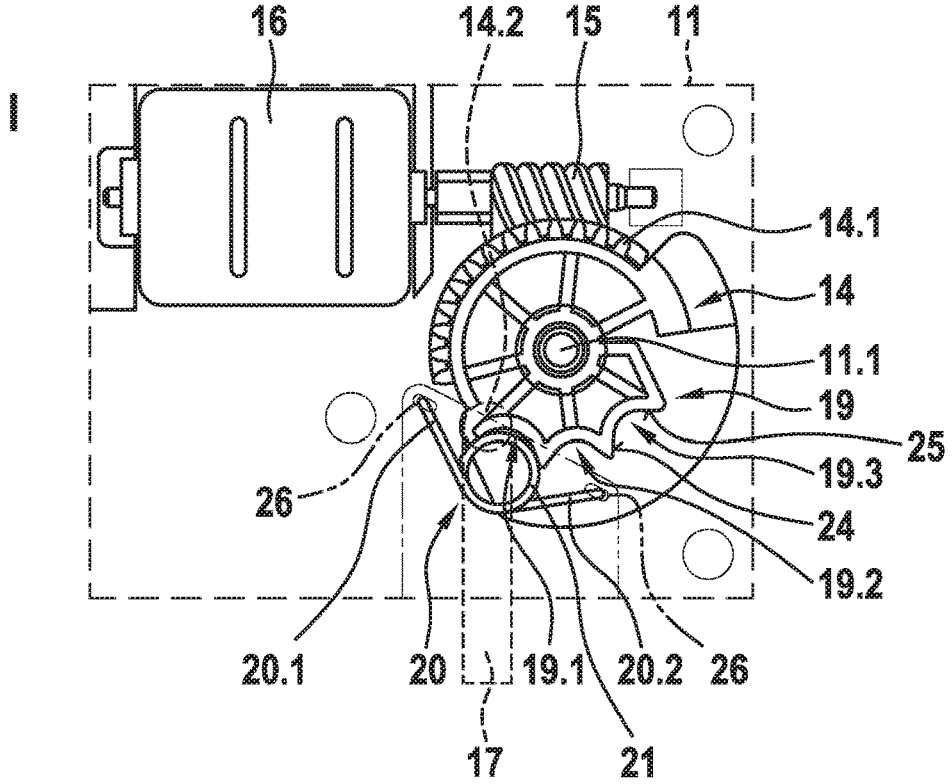
FIG. 1C is a cut-out of the motor vehicle latch in the first embodiment in position I.

FIG. 1*c* shows the embodiment in FIGS. 1A and 1B in which the drive element 14 and therefore the coupling element 17 are arranged in position I and therefore the functional position "child lock engaged." The additional features of the components shown correspond to those in FIGS. 1A and 1B. Accordingly, reference is made to a specific embodiment in FIGS. 1A and 1B at this point.

Figure 2A:
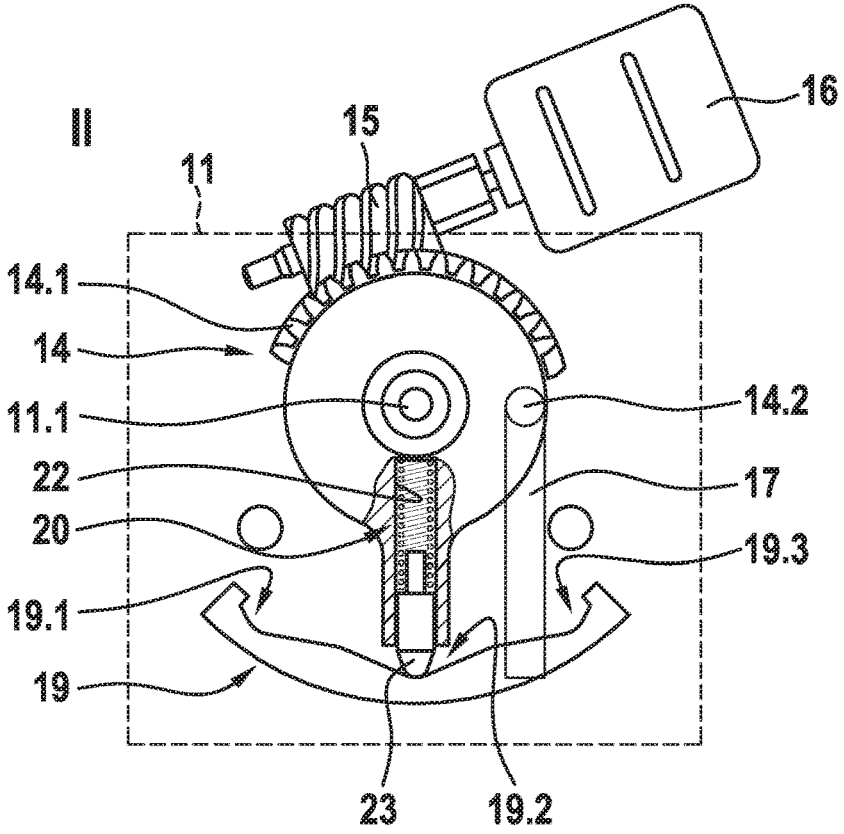
FIG. 2A shows another possible embodiment of a motor vehicle latch according to the invention in position II.

FIG. 2A shows another possible embodiment of a motor vehicle latch according to the invention, in particular an additional embodiment of a drive element 14 according to the invention and a ratchet contour 19. The spring mechanism 20 is formed as a pressure spring and is arranged on a drive element 14, it being possible for at least portions of the pressure spring to be brought into contact with the positioning notches 19.1, 19.2 or 19.3, which are arranged on a latch cover 11, as a result of which the different positions I, II and III may be maintained. In this case, the pressure spring is arranged in a spring receptacle 22 on the drive element 14. Furthermore, the spring mechanism 20 comprises a positioning element 23 at one end of the spring element, the positioning element being operatively connected to the pressure spring such that the positioning element 23 is pressed against the ratchet contour 19 and into the positioning notches 19.1, 19.2 or 19.3.

Accordingly, another embodiment is formed in which it is possible to accurately position the drive element 14 and therefore the coupling elements 17, 18. In this case, the pressure spring 20 is guided in the spring receptacle 22 such that it is possible for force to be transferred to the ratchet contour 19 and therefore the positioning notches 19.1, 19.2 and 19.3. The drive element 14 is rotatably arranged on a on a rotary shaft 11.1 on the latch cover 11. In addition, in the embodiment in FIG. 2A, the drive element 14 comprises an external teeth portion 14.1, which is in engagement with the screw conveyor 15, and therefore a force may be transferred from the motor 16 via the screw conveyor 15 to the drive element 14 via the external teeth portion 14.1 In FIG. 2A, the drive element 14 and therefore the coupling element 17, which is rotatably arranged on the bearing receptacle 14.2 of the drive element 14.

Figure 2B:
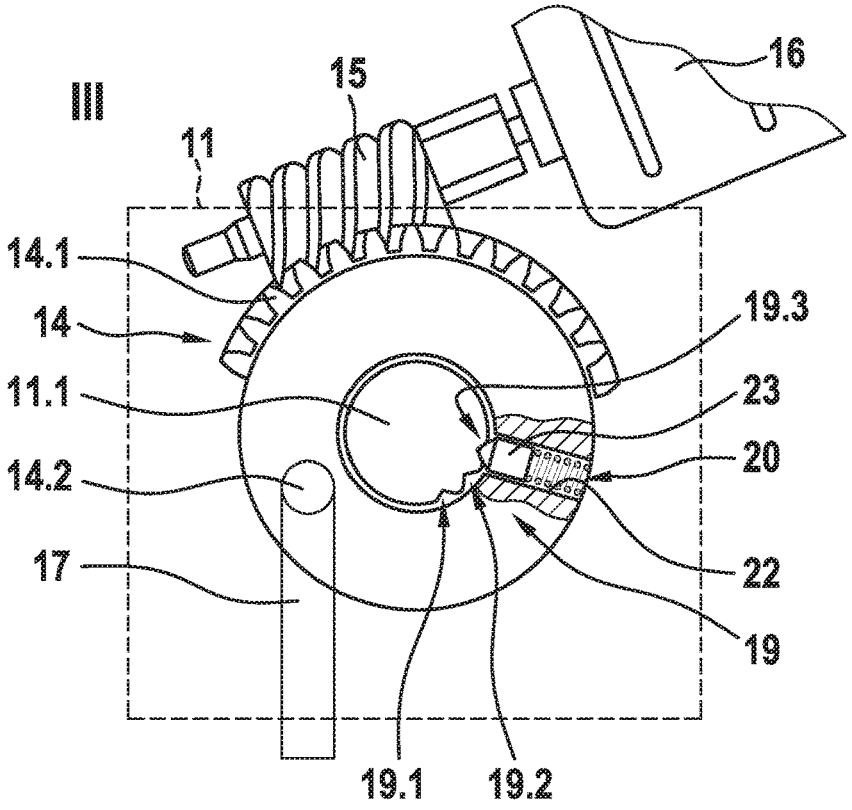
FIG. 2B shows another possible embodiment of a motor vehicle latch according to the invention in position III.

FIG. 2B shows another possible embodiment of the motor vehicle latch according to the invention, wherein the embodiment in FIG. 2B comprises a spring mechanism 20 having a pressure spring, a spring receptacle 22 and a positioning element 23. The spring mechanism 20 is arranged in the drive element 14 in this case, whereby, from now on the pressure spring and the positioning element 23 act on a ratchet contour 19 on the rotary shaft 11.1 of the latch cover 11. The rotary shaft 11.1 therefore comprises a ratchet contour 19 comprising the position receptacle 19.1, 19.2 and 19.3. In FIG. 2B, the positioning element 23 of the spring mechanism 20 is in position III.

In FIG. 2B, too, the coupling lever 17 is rotatably arranged in a bearing receptacle 14.2 of the drive element. Furthermore, in FIG. 2B the drive element 14 also comprises an external teeth portion 14.1, which may be brought into engagement with a screw conveyor 15 such that a force may be transferred via the on the motor 16 to the screw conveyor 15 and therefore to the drive element 14 by means of the external teeth position 14.1. The drive element 14 may therefore be transferred into the different positions I, II and III and therefore into the different functional positions.

Figure 3:
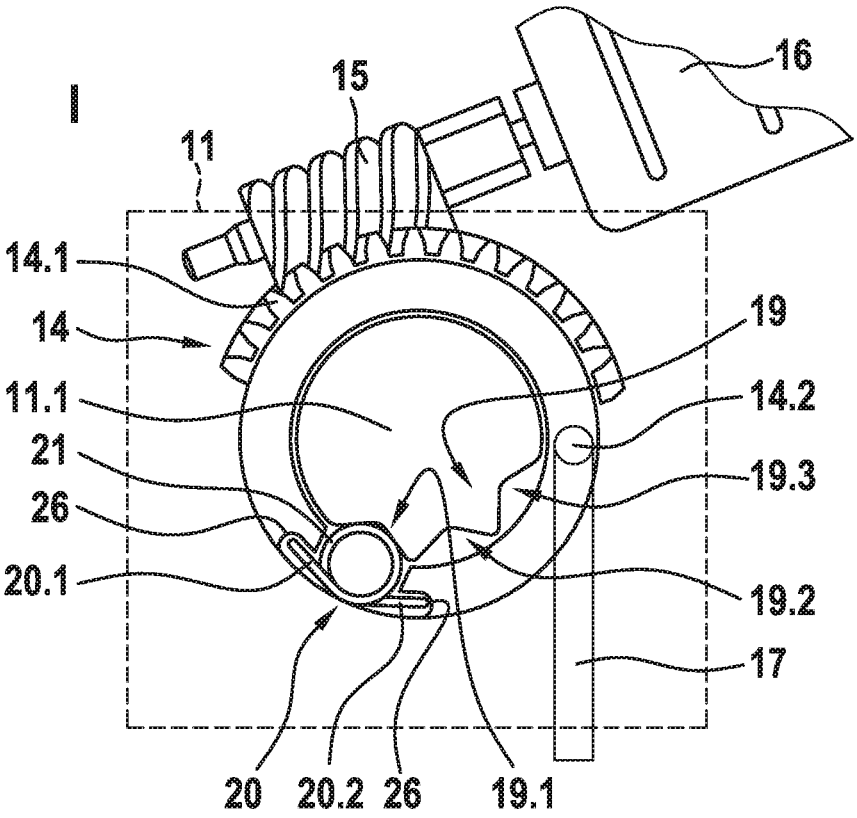
FIG. 3 shows another possible embodiment of a motor vehicle latch according to the invention in position I.

FIG. 3 shows another possible embodiment of a motor vehicle latch according to the invention, in which a spring mechanism 20 is arranged on the drive element 14. The spring mechanism 20 is formed as a double leg spring in this case and comprises a fastening end 20.1 and a second fastening end 20.2, which are arranged in the fastening receptacles 26 on the drive element 14. In this case, the double leg spring 20 comprises a turn portion 21, which is formed together with a ratchet contour 19 of the rotary shaft 11.1 of the latch cover 11. In this case, the ratchet contour comprises the positioning notches 19.1, 19.2 and 19.3.

In FIG. 3, the turn portion 21 of the spring mechanism 20 is arranged in the positioning notch 19.1 and at at least two points of contact and operatively connected to the positioning notch 19.1 such that position I and therefore the functional position "child lock" may be engaged but deflectable. In FIG. 3, too, the coupling element 17 is rotatably arranged on the drive element 14 in a bearing receptacle 14.2. In FIG. 3, too, the drive element comprises an external teeth portion 14.1, which may be operatively connected to a screw conveyor 15 such that the motor 16 may drive the screw conveyor 15 and transfer the drive element 14 into positions I, II or III.

Figure 4:
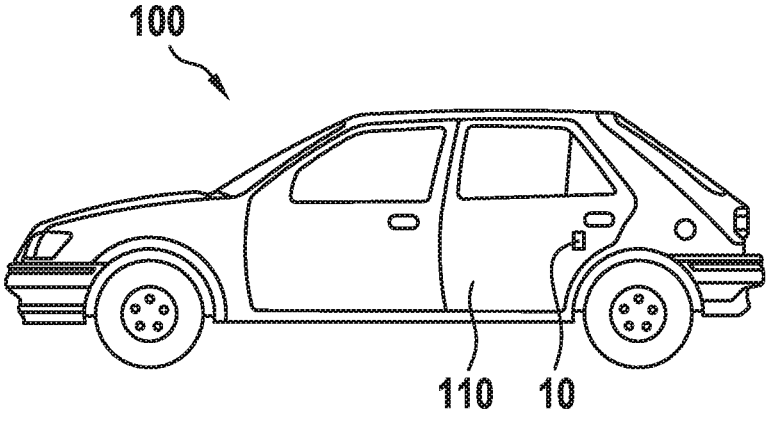
FIG. 4 shows a motor vehicle comprising a motor vehicle latch according to the invention.

FIG. 4 shows a motor vehicle 100 comprising a motor vehicle latch 10 according to the invention on a movable part 110 of the motor vehicle 100. The movable part 110 is shown as a rear door of the motor vehicle 100 in FIG. 4 such that the motor vehicle latch 10 is formed as a motor vehicle latch of a vehicle rear door.

List of reference signs

10 motor vehicle latch
11 latch cover
11.1 rotary shaft
12 catch
13 pawl
14 drive element
14.1 external teeth portion
14.2 bearing receptacle
15 screw conveyor
16 motor
17 coupling element
18 coupling element
19 ratchet contour
19.1 first positioning notch
19.2 second positioning notch
19.3 third positioning notch
20 spring mechanism
20.1 first fastening end
20.2 second fastening end
21 turn portion
22 spring receptacle
23 positioning element
24 abutment surface
25 abutment surface
26 fastening receptacle, slot
30 transmission lever
40 central locking mechanism
100 vehicle
110 rear door
I first position
II second position
III third position

The invention claimed is:

1. A motor vehicle latch for a vehicle rear door, the motor vehicle latch comprising:

a latch cover;

a locking mechanism having a catch and at least one pawl;

at least one coupling element;

at least one electric drive having a drive element, wherein the at least one coupling element is configured to assume different positions and the at least one coupling element is configured to interact with the drive element and a central locking mechanism, the at least one coupling element being connected to the drive element to assume the different positions, wherein the drive element and/or the latch cover includes a ratchet contour having at least two positioning notches, wherein each positioning notch is U-shaped with two straight abutment surfaces; and a spring mechanism, wherein a turn portion of the spring mechanism is configured to act on at least one of the two positioning notches of the ratchet contour by means of a spring force whereby the at least one coupling element is positioned in the different positions and the drive element is held in the different positions by the spring force of the spring mechanism, and wherein the turn portion comprises two points of contact that engage the abutment surfaces when the turn portion acts on at least one of the two positioning notches.

2. The motor vehicle latch according to claim 1, wherein the spring mechanism is formed as a leg spring.

3. The motor vehicle latch according to claim 2, wherein the spring mechanism is arranged on the latch cover or on the at least one coupling element or on the drive element, wherein the turn portion of the spring mechanism acting on the at least two positioning notches of the ratchet contour fix the at least one coupling element in a position.

4. The motor vehicle latch according to claim 2, wherein the spring mechanism is formed as a pressure spring and is arranged on the drive element, wherein portions of the pressure spring are configured to contact the at least two positioning notches on the latch cover whereby the different positions are maintained.

5. The motor vehicle latch according to claim 4, wherein the pressure spring is arranged in a spring receptacle on the drive element.

6. The motor vehicle latch according to claim 3, wherein the drive element is formed as a worm wheel and comprises an external teeth portion that is engageable with the electric drive.

7. The motor vehicle latch according to claim 6, wherein the external teeth portion is formed in a first plane on a circumference of the drive element and the ratchet contour is formed in at least a different second plane.

8. The motor vehicle latch according to claim 6, wherein the spring mechanism includes at least two fastening ends, wherein each fastening end of the at least two fastening ends are arranged in a fastening receptacle.

9. The motor vehicle latch according to claim 6, wherein the at least one coupling element is rotatably mounted on a bearing receptacle on the drive element.

10. The motor vehicle latch according to claim 6, wherein the at least one coupling element includes two coupling elements, wherein a first coupling element is operatively connected to a second coupling element by a transmission lever.

11. A method for operating a child lock in a motor vehicle latch that comprises a latch cover, a locking mechanism having a catch and at least one pawl, at least one coupling element, and at least one electric drive having a drive element, the method comprising:

moving the at least one coupling element to assume different positions, wherein the at least one coupling element interacts with the drive element and a central locking mechanism;

connecting the at least one coupling element to the drive element to assume the different positions, wherein the drive element and/or the latch cover comprises a ratchet contour having at least two positioning notches, wherein each positioning notch is U-shaped with two straight abutment surfaces;

engaging a turn portion of a spring mechanism with the at least two positioning notches of the ratchet contour by means of a spring force of the spring mechanism whereby the at least one coupling element is positioned in the different positions and the child lock is engaged, disengaged and/or released and the drive element is held in the different positions by the spring force of the spring mechanism, wherein the turn portion comprises two points of contact that engage the abutment surfaces when the turn portion engages with at least one of the at least two positioning notches.

12. The motor vehicle latch according to claim 2, wherein the leg spring is a double leg spring.

13. The motor vehicle latch according to claim 5 further comprising a positioning element that is operatively connected to the pressure spring, wherein the positioning element is pressed against the ratchet contour.

14. The motor vehicle latch according to claim 13, wherein the positioning element is arranged at one end of the pressure spring and an opposite end of the pressure spring is supported against the spring receptacle.

15. The motor vehicle latch according to claim 8, wherein the fastening receptacle is formed as a slot.

16. The motor vehicle latch according to claim 10, wherein the second coupling element is formed as an external locking lever.

* * * * *